United States Patent [19]

Malvick et al.

[11] 4,205,752

[45] Jun. 3, 1980

[54] COLOR SORTING OF PRODUCE

[75] Inventors: Arnold O. Malvick, Manteca; Wayne W. MacDonald, Oakdale; Carl M. Beckwith, Modesto, all of Calif.

[73] Assignee: Tri/Valley Growers, San Francisco, Calif.

[21] Appl. No.: 815,144

[22] Filed: Jul. 13, 1977

[51] Int. Cl.[2] ..... B07C 5/342

[52] U.S. Cl. ..... 209/564; 209/551; 209/582; 250/223 R; 356/407

[58] Field of Search ..... 209/74 R, 74 M, 111.6, 209/551, 580, 581, 582, 559, 563, 564; 250/223 R, 226; 356/178, 407

[56] References Cited

U.S. PATENT DOCUMENTS

| | | | |
|---|---|---|---|
| 2,988,219 | 6/1961 | Bartlett | 209/111.6 |
| 3,750,883 | 8/1973 | Irving et al. | 209/111.6 |
| 3,757,943 | 9/1973 | Chae et al. | 209/551 |
| 3,998,555 | 12/1976 | Babb | 356/178 |
| 4,057,146 | 11/1977 | Castaneda et al. | 209/111.6 X |

*Primary Examiner*—Joseph J. Rolla
*Attorney, Agent, or Firm*—Edward B. Gregg; Willis E. Higgins

[57] ABSTRACT

An automated color sorter for fruit and the like produces signals in the red and green spectrum from light reflected by each piece of produce passing an inspection station and operates upon these signals to generate color level signals employed to physically direct individual items according to predetermined color grades thereof. Computer operation upon the color level signals allows variation of sort levels or points and continuous inventorying of produce in predetermined grades.

15 Claims, 5 Drawing Figures

COLOR SORTING OF PRODUCE

BACKGROUND OF THE INVENTION

In the processing of produce such as fruits for canning it is normally necessary to grade the fruit and sort it by grades for ultimate appropriate labeling of cans or the like. At least some types of fruit are normally graded by color and this is conventionally carried out by inspectors visually viewing fruit passing along a sorting line and physically separating the fruit into various categories or grades. This type of sorting is not only time-consuming and expensive, but is also subject to fairly wide fluctuations and variations depending upon a number of human factors which in themselves are variable. Consequently, conventional color sorting of fruit is quite inexact.

Prior art attempts to automate color sorting operations have been at least partially successful in some fields, but to date, have not found acceptance in the field of fruit grading. Thus in the grading of peaches for canning, it is recognized that varying sizes and contours of peach halves, for example, involve problems not readily handled by conventional equipment. Further to this example, it is noted that peaches are normally graded as standard, choice, or fancy, depending upon the degree of ripeness and containers of canned peaches are marked for sale with an appropriate one of these appelations. The grading of peaches into these categories is carried out in accordance with the color of peeled peach halves prior to canning and conventionally the center grade, choice, has a yellow color with less ripe or greener fruit being denominated standard, and fully ripe fruit, denominated as fancy, having a yellow-/orange color. Clearly, the differences in color are somewhat subjective, although governmental regulations may provide some basic grading criteria. Visual color sorting by human operators or inspectors is a poor manner of achieving reproduceable results, but to date, it is yet the best way known to the industry.

SUMMARY

The present invention provides a high speed positively operated grading and sorting method and system for physically separating produce into separate groups or categories upon the basis of color as a measure of ripeness. One or preferably a number of conveyor belts are employed to pass successive items of produce such as peach halves, cup down, through an inspection station, whereat a steady light is directed downward onto the stream or streams of peach halves and a pair of sensors are employed for each stream to generate electrical signals representative of the intensity of light reflected from successive items in predetermined color bands. In the present description of the present invention, the sorting of peach halves is employed as a representative example and this sorting is accomplished by measuring the reflection of green light and red light.

Peach halves are herein color sorted by moving successive halves, cup down, in a single file at a uniform velocity, past a pair of closely-spaced sensors having appropriate light filters to limit one sensor to light in the green band of the spectrum and the other sensor to light in the red band of the spectrum. The photosensor signals are briefly stored and are then operated upon to generate a digital number that is representative of the color or ripeness of the peach half, and thus to produce a color level for each peach half. Two predetermined but adjustable color level sort points are established by the invention, and peach grading is obtained by comparing the color level of each peach half to these sort points.

Actual sorting of peach halves is herein accomplished by appropriate delay of each color level signal and then application of same to sorting mechanism in accordance with the relationship thereof to the sort point or level. Air jets or moveable paddles may be employed to physically move individual peach halves from a common stream thereof into sorted streams and appropriate timing relative to velocity of peach half movement is provided to insure proper sorting.

The present invention preferably incorporates one or more computers or at least microprocessors for receiving and operating upon sensor signals. It is not, however, necessary for the present invention to include sophisticated computer equipment for manual setting of sort points is possible. With computing capabilities, the present invention may be arranged to count the number sorted into each category and even to reset sort points in accordance with predetermined percentages desired in each sorting category.

DESCRIPTION OF FIGURES

The present invention is illustrated as to a single preferred embodiment of the present invention in the accompanying drawings, wherein.

DESCRIPTION OF PREFERRED EMBODIMENT

Figure 1:
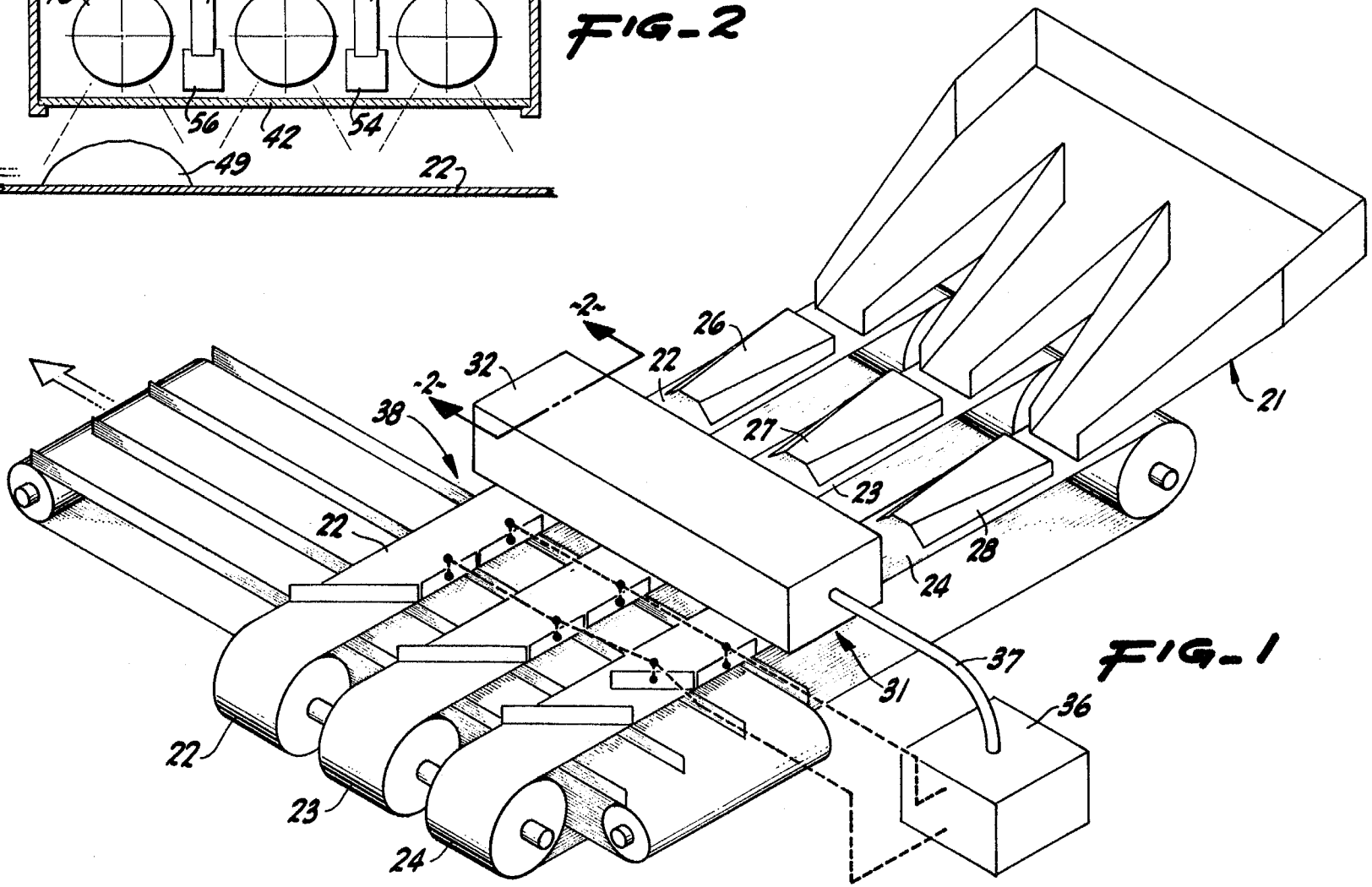
FIG. 1 is a schematic perspective illustration of a sorting system in accordance with the present invention.

The present invention is illustrated in the accompanying drawings and described in the following specification in connection with the sorting of peeled peach halves into several grades by color. In accordance with general practice, the peach halves are sorted into three categories, wherein standard is the greener fruit, choice is yellow fruit, and fancy is yellow/orange or riper fruit. The invention is applicable for use with any number or lanes or belts, and in FIG. 1 of the above drawing, there is illustrated a three-lane system. The transport mechanism employed by the present invention may be quite conventional, and no attempt is made herein to illustrate or describe details thereof. In FIG. 1, there is illustrated a three-lane shaker and cup-down aligner 21 which is adapted to be loaded with peeled peach halves and which supplies successive peach halves to each of three transport belts 22, 23 and 24, suitably driven by means, not shown, to move the upper surface thereof generally to the left in FIG. 1. Peach half aligners 26, 27 and 28 are provided one upon each of the belts 22 to 24 respectively, for ensuring centering of each peach half in the center of the belt as it is transported thereby. It is noted that proper separation between peach halves on each belt is important, and appropriate additional means may be provided for this purpose, such as feeding of each belt with a slower moving belt in conventional manner. Preferably, the belts 22 to 24 have an outer surface that is black, in order to provide a substantially zero light reflection therefrom, although it is possible to employ lighter colored belts with appropriate circuit modification to accommodate for light reflected from the belts.

Each of the transport belts 22 to 24 pass through an inspection or grading station 31 which includes a light and sensor unit 32 disposed immediately above the belt and extending transversly thereacross, as shown in FIG. 1. The light unit 32 directs light upon peach halves transported by the belts 22 to 24 and incorporates sensors, as further discussed below, for receiving light reflected from successive peach halves. The output from the sensors of the light unit 32 is applied to a control unit 36, as indicated by the cable 37, and this control unit 36 operates sorting means 38 associated with the transport belts 22 to 24 beyond the inspection or sorting station 31. These sorting means serve to direct successive peach halves upon each of the belts 22 to 24 into areas for reception of peach halves of particular color categories, as further described below.

Figure 2:
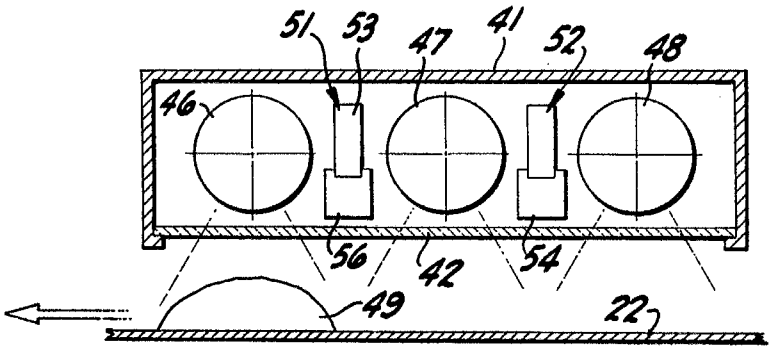
FIG. 2 is a transverse sectional view through a light source and sensors as employed at an inspection station in accordance with the present invention.

The light unit 32, as illustrated in FIG. 2, includes a light-tight box or housing 41 having a transparent bottom window 42 spaced above the belts 22 to 24. Within the housing 41, there are provided a number of fluorescent lamps 46, 47 and 48 disposed longitudinally of the housing across the belts 22 to 24. It will be seen that as a peach half 49 is moved by the belt 22, for example, beneath the light unit 32, the light from lamps 46 to 48 will be directed immediately onto the peach half for reflection therefrom. Also disposed within the housing 41 are a pair of sensor assemblies 51 and 52 for each of the belts 22 to 24. The sensor assemblies are disposed on opposite sides of the central lamp 47, as illustrated. The sensor assemblies are similar in that each includes a photo transistor 53 mounted in an appropriate holder equipped with a lens. A green filter 54 is attached to the assembly 52, and a red filter 56 is attached to the assembly 51.

It will thus be seen that the sensor assembly 52 is adapted to receive light in the green band of the spectrum as reflected from a peach half 49 passing beneath the window 42 and the sensor assembly 51 is adapted to receive red light reflected from a peach half 49 passing beneath window 42. As noted above, the peach halves are carefully centered on the belts so that a single peach half passing beneath the sensor assemblies 51 and 52 will reflect a certain intensity of green light into the assembly 52 and a certain intensity of red light into the assembly 51, with such intensities depending upon the actual color of the peach half in question.

Figure 3:
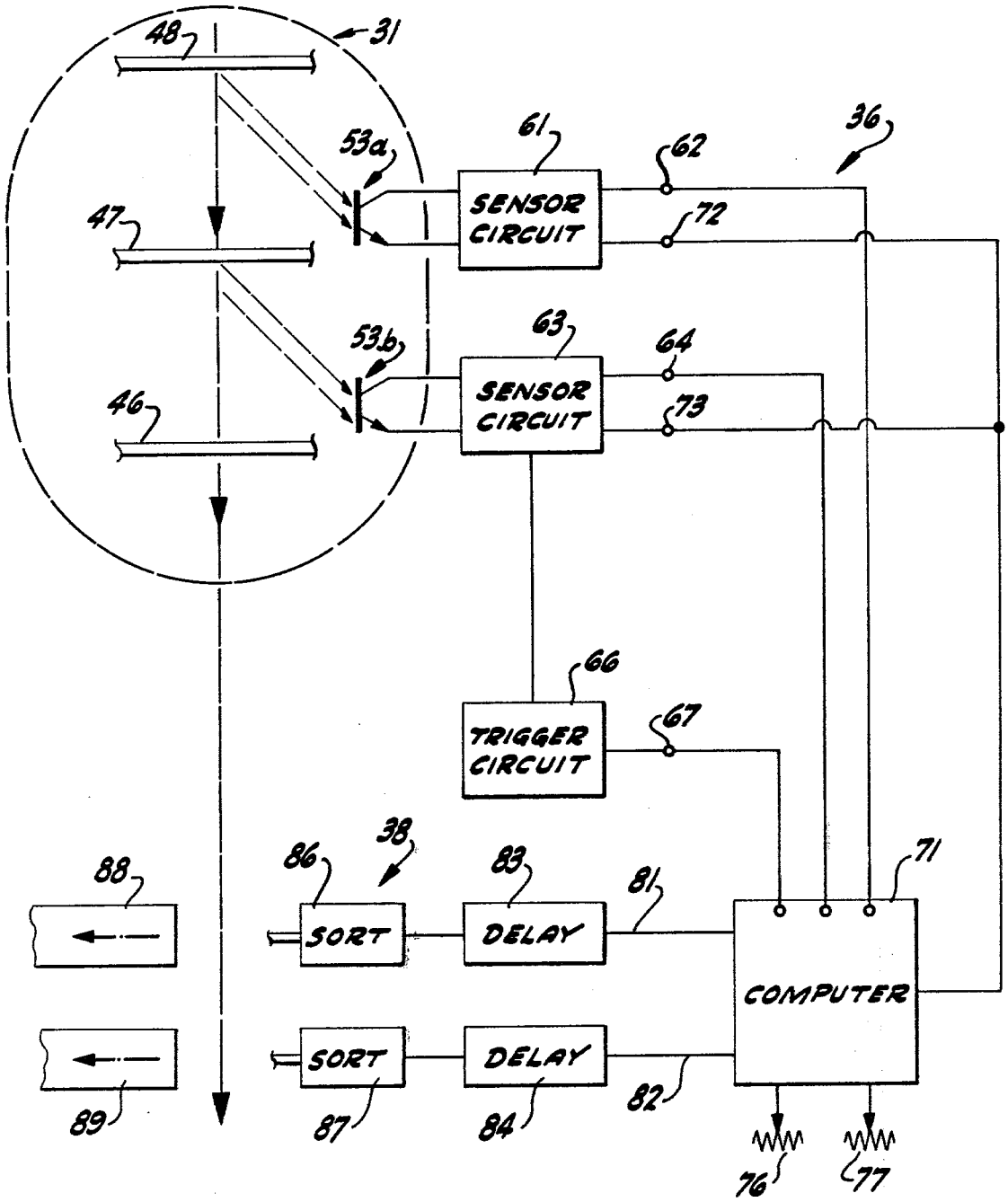
FIG. 3 is a schematic block diagram of the present invention.

In FIG. 3 of the drawings, there is schematically illustrated an inspection or sorting station 31 and control circuitry 36. A first photosensor **53*a* is shown to be connected to a sensor circuit 61 which produces an output signal at terminal 62 which has an amplitude proportional to the intensity of light in the green band of the spectrum, as reflected from a peach half at the station 31. As noted above, a green filter is provided ahead of the sensor 53*a* and thus the signal at output terminal 62 is related to the green light reflected from a peach half. A second sensor 53*b* having a red filter ahead of same, is shown to be connected to a sensor circuit 63 applying a signal to an output terminal 64 which has an amplitude proportion to red light reflected from the same peach half at the inspection or grading station 31. The sensor circuit 63 is shown to be connected to a trigger circuit 66 having an output terminal 67 at which there is applied a signal indicating passage of a peach half through the station 31**.

The sensor terminals 62 and 64, as well as the trigger terminal 67, are shown in FIG. 3 to be connected to input terminals of a computer or processor 71. The computer or processor 71 is adapted to perform certain functions upon the sensor signals at the command of the trigger signal and after receipt of these signals, this unit 71 produces a reset signal applied to terminals 72 and 73 of the sensor circuits 61 and 63, respectively. The reset signal from the computer 71 serves to return the photosensor assemblies and associated circuits to initial condition for receiving information from the next successive peach half passing through the inspection or sorting station 31. The computer 71 determines the color category of each successive peach half passing through the station 31 and under appropriate circumstances produces an output signal upon output line 81 or output line 82 for operating the sorting equipment 38. From the sensor signals, each peach half is accorded a color level, and this level is then determined by the computer 71 to fall within one of the three predetermined color categories of standard, choice, or fancy. The sort points, i.e. color levels at the boundaries of these categories may be manually adjusted or established by manual setting means as schematically illustrated at 76 and 77 of FIG. 3. Alternatively, the computer 71 may be programmed to internally determine the sort points and, in fact, to vary the sort points in accordance with the percentage of peach halves desired to be located in the separate color categories. This point is further discussed below, however, it is noted that whatever the complexity of the computer unit 71, it is provided in accordance with the present invention that this unit shall determine the relationship of each peach half color to the predetermined sort points of color and to produce output signals for operating sorting mechanism to dispose successive peach halves in areas adapted to receive standard, choice, and fancy fruits.

A simple manner of sorting peach halves, comprises the deflection of standard halves and fancy halves from a conveyor belt while allowing choice halves to proceed on the belt to an ultimate destination. The standard halves are moved into one area, and the fancy halves into another, as, for example, by air jets. In FIG. 3, the output lines 81 and 82 are shown to be connected to delay circuits 83 and 84 respectively, for applying delayed signals to sorting elements 86 and 87. In this illustration, it is provided that signals from the station 31 identifying a peach half passing therethrough as having a color level in the standard range shall cause a signal to be applied to the output line 81, with this signal then being appropriately delayed until this particular peach half is aligned with a sorting element 86 which is then actuated to physically move this peach half onto an appropriate belt 88, for example, which leads to an area for receiving peaches having a color in the range defined as standard. Another peach half detected at the station 31 as having a color level in the category of fancy will cause an output signal on line 82 which is appropriately delayed to operate the sorting element 87 at the proper time to displace this peach half onto a belt 89, for example, for delivery of the peach half to an area for receiving fancy peaches. The sorting elements 86 and 87 illustrated in FIG. 3 may, for example, only comprise air jets actuated by suitable solenoid control valves by output signals from the computer, although alternate types of sorting means may also be employed as further described below.

Figure 4:
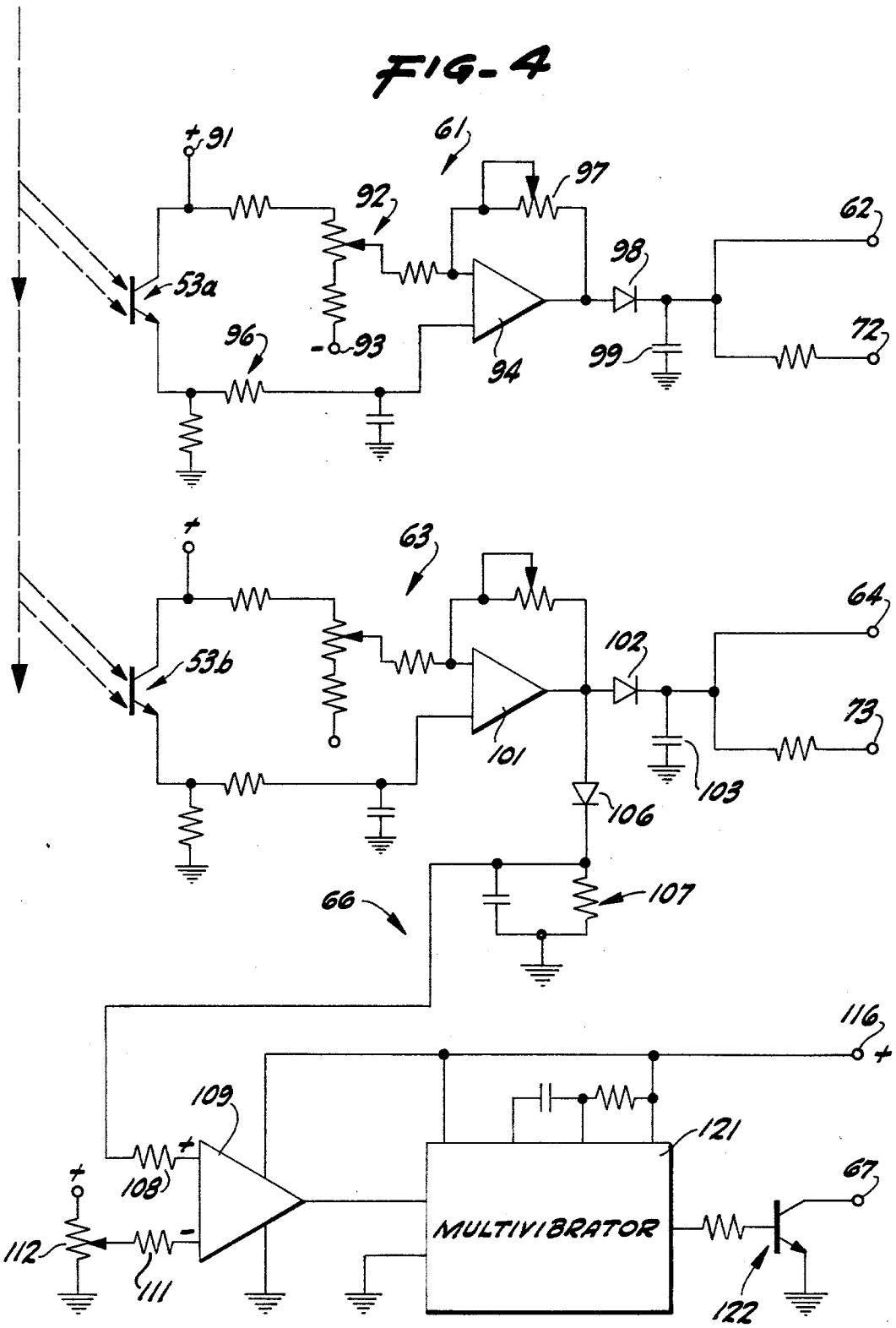
FIG. 4 is a circuit diagram of electronics associated with an inspection station in accordance with the present invention.

Reference is now made to FIG. 4 of the drawings, illustrating at the upper portion thereof the sensor circuit 61 connected to the photosensor 53*a*. The sensor 53*a*, which is shown to comprise a photoresponsive transistor, has the collector thereof connected to a positive power supply terminal 91, which is connected through fixed resistors and the resistor of a potentiometer 92 to a negative power supply terminal 93. In this manner, a zero adjustment for the sensor is provided and the moveable contact of the potentiometer 92 is connected through a resistor to the negative input of an amplifier 94. The emitter of the sensor 53*a* is connected through an RC circuit 96 to the positive input of the amplifier 94 which is provided with a variable feedback resistor 97 as a gain adjustment for the sensor. The output of the amplifier 94 is coupled through a diode 98 to one side of a capacitor 99 having other side thereof grounded for storing the analogue signal produced by the sensor 53*a* and amplified by the amplifier 94. The ungrounded side of the capacitor 99 is connected to the output terminal 62 and the reset terminal 72 is resistively coupled to the same side of the capacitor for discharging the capacitor after the signal thereon has been sampled by the computer 71.

The sensor circuit 63 for the photosensor 53*b* will be seen to be substantially identical to the sensor circuit 61 described above, and thus the individual elements thereof are not separately numbered other than the amplifier 101 and the diode 102 coupling the amplifier output to the capacitor 103. It will be seen at the left of FIG. 4 that the dashed line with arrows thereon indicates the passage of a peach half through the sorting station including the sensors 53*a* and 53*b*, so that once the peach half has passed the sensor 53*b*, the information obtained at the sorting station has been completed. The present invention operates to produce a trigger signal as the output of the amplifier 101 in the circuit of sensor 53*b* drops below some adjustable level. This occurs as the peach half is leaving the area of sensor 53*b*. As shown in FIG. 4, the output of the amplifier 101 is coupled through a diode 106, a grounded RC circuit 107, and a resistor 108 to a positive input of a comparator 109. The negative input of the comparator 109 is connected through a resistor 111 to the moveable contact of a potentiometer 112 connected between a positive power supply terminal and ground so that the output of the comparator 109 is determined by the difference between the two input signals with the level of comparison being adjustable by the potentiometer 112. The comparator 109 comprises a differential amplifier having the output thereof coupled to a monostable multivibrator 121, having the output thereof resistively coupled to the base of a transistor 122 which has the emitter grounded and the collector connected to the trigger terminal 67. The multivibrator 121 includes an inverter and AND circuit in the integrated circuit package thereof and a positive power supply terminal 116 is connected to the comparator and multivibrator.

The foregoing circuitry operates to apply a trigger pulse to the trigger terminal 67 at such time as the capacitors 99 and 103 of the sensor circuits 61 and 63 have been fully charged to the degree dictated by the associated sensors which is proportional to the green and red signals, and a peach half leaves sensor 53*b*. The analogue signals on the capacitors 99 and 103 are then read or sampled by the computer or the like 71, as Green and Red analogue data. Once the sampling has been completed, the computer or the like 71 produces a reset command applied to the terminals 72 and 73 for discharging the capacitors 99 and 103. Inasmuch as the belt carrying the peach halves is black, there will be very little reflected light from the belt and consequently, negligible recharging of the capacitors will occur before another peach half arrives at the inspection or grading station.

The sample Green and Red data or values are operated upon by the present invention to generate a number in a range of numbers representative of color. One equation that may be employed to accomplish the foregoing and to calculate the color level of each peach half passing through the inspection or sorting station is set forth below.

$$\text{Color Level} = (2 \times \text{Red})/(\text{Green} + \text{Red}) \times 1000$$

It will be seen from the foregoing equation that the computer, micro processor, or other unit employed in the present invention, multiplies the Red value by 2 and divides this by the sum of the Green value and Red value with the quotient then being multiplied by 1000. This equation is not the only one that can be employed, however, it does provide some compensation for lightness or brightness of peach halves. The color level number obtained from the foregoing manipulation or calculation is a number between zero and 2000 with riper fruit providing higher numbers. Within the computer or the like 71, there are assigned or entered two sort points which are, in fact, the color levels at the boundaries between standard and choice and between choice and fancy. These sort points establish or comprise the limits of the separate grades of fruit. Each peach half passing through the inspection or sort station, causes a color level signal to be generated identifying the ripeness of that particular peach half. The computer or the like determines the category in which the particular color level signal falls and if the level number is less than the sort point between standard and choice, there will be produced an output signal on the line 81 or operating sorting means 86 to direct or physically displace the particular peach half onto delivery means 88 whereat the peach half is delivered to a container or area for standard fruit. If the color level signal or count is determined by the computer to fall in excess of the sort points between choice and fancy, an output signal will be produced on the line 82, for operating the sorting means 87 to physically direct the particular peach half onto delivery means 89 whereby this peach half is then transported to an area or container for fancy fruit. In the embodiment of the present invention illustrated in FIG. 3, for example, the color level signal for a particular peach half which has a value in excess of the sort point between standard and choice, but less than the sort point between choice and fancy, will produce no output, so that this particular peach half would then continue along the normal transport to deliver the peach to an area or container for choice fruit. It is, of course, also possible to provide a sort signal for choice fruit for operating a deflector or the like, for physically displacing choice fruit from the normal transport belt onto an alternative belt or the like delivering the fruit to an area for choice fruit, although the simpler system wherein no displacement of the choice fruit from its normal travel occurs is preferred for many applications.

Identification of the ripeness of the fruit passing through an inspection or sorting station 31 provides the information upon which sorting is accomplished, and it is noted that the present invention is not limited to sorting among only three grades. Additional sort points may be employed in accordance herewith and thus, for example, a sort point may be established to identify overly green fruit and another sort point established to identify overripe fruit, so that these substandard items may be removed from the packing operations. The physical operation of sorting may be carried out in a variety of ways as briefly noted above, however, it is provided herein that sort signals from the computer or the like 71 shall be carefully employed in relationship to the physical location of successive peach halves, in order to ensure correlation between detected ripeness and subsequent sorting.

Figure 5:
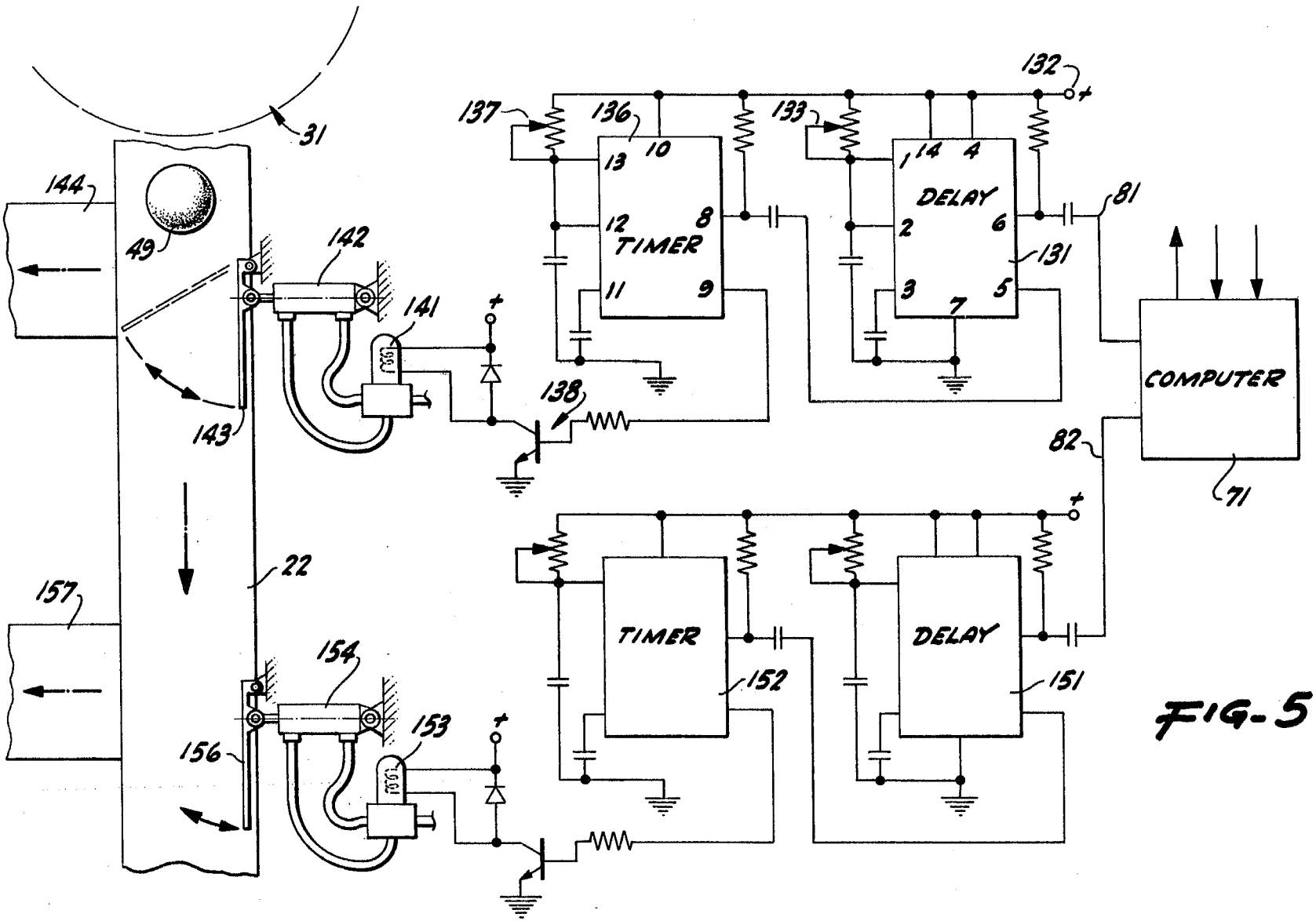
FIG. 5 is a circuit diagram of actuator circuitry in accordance with the present invention.

Referring now to FIG. 5 of the drawings, there will be seen to be shown a computer or the like 71 having output lines 81 and 82 upon which there are provided signals representative of color levels of successive peach halves passing through an inspection station 31 and falling within the predetermined categories of standard or fancy. The output line 81 will be seen to be capacitively coupled to an input of a delay circuit 131 with the input lines being resistively coupled to a positive power supply terminal 132. The delay circuit 131 is commonly provided as an integrated circuit element normally forming a part of a chip and having a plurality of terminals, which, in FIG. 5 are numbered in accordance with conventional numbering of an integrated circuit element, as may be purchased, for example, from Signetics under the denomination NE556A. One of the inputs to the delay circuit 131 is connected through the variable resistor 133 to the positive power supply terminal 132 for the purpose of establishing the delay time of the signal passed by the circuit 131. The output signal of circuit 131 is applied from terminal No. 5 thereof through a capacitor to an input terminal of a similar integrated circuit 136 and both units 131 and 136 may be part of a single integrated circuit in one package. The delay circuit 131 provides for delaying the output thereof a predetermined period of time which is adjusted to provide for an output signal at the time that a peach half has passed from an inspection station to a sorting station. It will be appreciated that this time delay is determined by the speed of the transport belt 22, for example, and the physical separation of the inspection and sorting station from the sorting equipment. If the distance between the inspection station and sorting location is unduly long so that a number of peach halves may be located therebetween alternative delay means may be required in order to provide a sufficient delay time. One method of providing a longer delay time is to employ shift register techniques wherein a clock rate controlling shift timing is synchronized with belt speed so that a "bit" which is set when a particular color grade of peach half is identified will cycle through a register and actuate the output timer when the peach half reaches the deflection or sorting point or location. Other delay and timing means may also be employed, however, it is necessary to time the sorting so that the proper peach half will always be operated upon in accordance with the detected color level thereof. Returning to the circuit of FIG. 5, it will be seen that the timer 136 is also provided with a variable resistor 137 connecting one of the inputs thereof to the positive power supply terminal 132, in order to establish the time duration of the output from this circuit. The output signal at terminal 9 of the timer 136 is applied through suitable driver and transient suppression circuitry 138 to the coil of a solenoid-operated air valve 141 which is connected to operate an air cylinder 142 that has a piston rod thereof connected to move a paddle or gate 143 laterally across a transport belt 22, for example. It will, of course, be appreciated that the air cylinder 142 is appropriately mounted, as by pivotable connections to pivot the gate or paddle 143 laterally across the belt 22 upon actuation from the solenoid-operated valve 141 in accordance with the output of the timer 136. With the appropriate delay, as provided by circuit 131, a "standard" signal or color level indication from the computer or the like 71 will thus serve to actuate the sorting means, provided in this instance as a pivotally mounted paddle or the like 143, so as to physically engage the peach half producing the "standard" color level signal so that this peach half 49 will be directed laterally of the belt 22 onto a further laterally moving belt 144 to carry this particular peach half to an area or container adapted to receive peach halves sorted in accordance with the present invention as having a "standard" ripeness or color.

It will be appreciated that the present invention provides a determination for each peach half passing through an inspection or sorting station and this determination may, for example, identify a particular peach half as "fancy". Under these circumstances, a signal will be provided by the computer or the like 71 upon the output line 82 thereof, whereby this signal is then delayed a predetermined period of time by a delay circuit 151 and applied to a timer 152 for supplying an actuating signal of predetermined duration to a solenoid-operated air valve 153 connected to a source of compressed air or the like and selectively operating an air cylinder 154 for pivoting a gate or paddle 156 laterally across the belt 22 so as to intercept and redirect a peach half 49, for example, laterally off of the belt 22 onto a belt 157. A peach half deflected onto the belt 157 will be moved by such belt to an area or container for "fancy" peach halves in accordance with the sorting operation of the present invention. It will, of course, be appreciated that in the illustrated embodiment of the invention, the time delay provided by circuit 151 in the illustrated embodiment of FIG. 5 is greater than the time delay provided by the circuit 131, inasmuch as the deflecting gate or paddle 156 is disposed at a greater distance from the inspection station 31 than is the deflections means 143. However, it is possible to position both deflectors equidistant from the inspection station by placing one on one side of belt and one on other side of the belt and using suitable "chutes" to guide peaches to desired cross belts.

The present invention has been described above with respect to the utilization of a computer 71, although there have been noted certain variations therein that are possible in accordance with the present invention. As a practical matter, it is possible to minimize the complexity of the present inventiion merely by utilizing a manual setting for the value of the sort points in the sorting operation of the present invention and applying simple straightforward electronics to perform the calculations required herein. For some applications, this minimum approach may be most desirable, however, it is noted that normal canning or packing plants operate a large number of lines at the same time and during the canning season for peaches, for example, it is conventional to can peaches from a large number of lines because of the necessity of rapidly handling ripening fruit. In such circumstances, it is quite practical to utilize one or more computers of varying degrees of complexity in connection with the control of canning operations. The present invention provides a control method and system in canning operations wherein one or more computers may be advantageously utilized to sort or grade fruit to be canned. Actually, the number of separate lines or conveyor belts which may be controlled by a single computer depends in part, upon the volume of fruit on each belt and the time required for the computer to sample the analogue data from successive pieces of fruit in each line. By utilizing more and faster analogue to digital convertors, it will be appreciated that a single computer could handle enough lanes for an entire canning or packing plant. It is, however, noted in this respect, that one limiting factor may be the number of lanes that could possibly be tolerated to be out of service at one time as a result of a possible computer failure.

The present invention has been described above in connection with the utilization of a computer for three lanes or converter belts, however, a more practical and general approach to the overall problem of sorting fruit in accordance with ripeness thereof is probably the utilization of an individual or separate minicomputer or microprocessor for each lane or few numbers of lanes. Each such microprocessor may be programmed to handle data sampling, reset, color level, generation of new sort points, color determination and deflection command. One microprocessor or the like may be adequate to handle the foregoing for two, three, or more adjacent lanes or conveyor belts of a packing plant and each microprocessor may then be connected to supply information to a master computer, wherein there may be generated reports, such as the percent and volume of each grade in each lane and wherein basic decisions may be made regarding the location of sort points, for example, with such information then being transmitted back to individual microprocessors for implementation. With a fully automated system, an operator may enter into a computer or the like, the desired percentages of each grade for each lane or transport belt of the packing plant and consequently, the sort points will be shifted up or down according to the desired packing goals. The computer periodically evaluates the sort percentages for each lane and may, in fact, generate new sort points to maintain the desired percentages for each grade. Naturally, the capability is retained for an operator to enter actual sort points as an override to percentage determinations of sort points. Should the systems be set up to operate in an automated mode, it will be appreciated that certain limits would be inserted in the computer programming to prevent violating grade color standards if, for example, there were not enough fruit of a particular color to provide the desired percentages. It is not intended to indicate herein that the present invention is dependent upon the operation of a computer, however, because of the nature of packing plants and the large scale operations normally associated therewith, it is quite practical and normally advantageous to utilize highly sophisticated equipment in the control of the present invention. Thus the present invention is particularly adapted to utilization with a computer that may, for example, be also otherwise employed in the packing plant for the control of many operations therein.

The present system and method of the present invention has been described above with respect to a particular preferred embodiment of the invention, however, it will be apparent to those skilled in the art that numerous modifications and variations of the present invention are possible within the spirit and scope of the present invention. It is not intended to limit the present invention to the particular terms of description or details of illustration.

What is claimed is:

1. A sorting system for produce adapted to separate successive items of produce in accordance with the color thereof comprising, transport means adapted to move successive items of produce through an inspection station;

means directing light upon said items as they pass through said inspection station;

a pair of light sensors disposed at said inspection station and directed toward items passing therethrough for producing sensor signals from light reflected from said items and each of said sensors having a light filter associated therewith for limiting light reaching the sensor to a predetermined color band with said color bands being located on opposite sides of the light spectrum from the colors to be employed in sorting of produce;

first data processing means receiving said sensor signals, carrying out data processing operations thereon for determining a color level for a piece of the produce on the basis of the sensed light, determining a relationship between the color level and predetermined color sorting levels, producing sort signals depending on the relationship, and resetting said sensors;

sorting means operated by said sort signals for directing items of produce into predetermined areas according to the color thereof, and second data processing means connected to said first data processing means to receive sort information therefrom, generate produce inventory information therefrom and adjust the predetermined sorting levels.

2. The system of claim 1 further defined by one of said light sensors having a green filter thereover, and one of said sensors having a red filter thereover.

3. The system of claim 1 further defined by said means directing light upon items at said inspection station including a plurality of fluorescent lamps extending laterally across a plurality of transport means adapted to move successive items of produce through said inspection station;

said light sensors being provided as two sensors for each transport means and disposed in pairs for viewing items transported through said inspection station by each transport means, the sensors of each pair having a green filter on one sensor and a red filter on the sensor of each pair;

said first data processing means combining the signals of each pair of signals in a predetermined manner and comparing the result to predetermined adjustable signal levels as sort points separating color categories for producing said sort signals, and said sorting means redirecting items of produce having a color level within said categories into separate areas.

4. The system of claim 1 further defined by electrical circuitry connected between said sensors and said first data processing means for producing analogue sensor signals and a trigger signal signifying passage of an item through said inspection station.

5. The system of claim 4 further defined by said light filters admitting only green light to one sensor and only red light to the other sensor, and said first data processing means operating upon green and red sensor signals to double the red sensor signals and divide same by the sum of the red and green sensor signals to produce a color level number for each item of produce and comparing said color level numbers to predetermined sort point numbers to produce said sort signals.

6. A system for sorting items of a single kind of fruit according to ripeness thereof as determined by color of fruit and for maintaining an inventory record thereof comprising at least one transport belt adapted to carry pieces of fruit at a predetermined velocity and separation between successive pieces through an inspection station;

said inspection station including a light source directing light downward upon fruit carried by said belts and a pair of light-responsive sensors aligned with each of said belts in spaced apart relation longitudinally thereof for receiving light reflected from pieces of fruit with a green filter on one sensor and a red filter on the other sensor of each pair of sensors;

sensor and trigger circuitry connected to each of said pairs of sensors for storing maximum sensor signals of red and green light and producing a trigger signal upon passage of each piece of fruit on a belt through said inspection station;

first digital computing means connected for operation to sample said stored sensor signals in response to said trigger signal and discharging said stored signals to reset said circuitry;

said first digital computing means operating to process said sensor signals to generate a color level for each piece of fruit and having adjustable sort points against which said pairs of sensor signals are compared to produce sort signals on separate output lines according to the color level of each piece of fruit in relation to said sort points;

sorting means disposed adjacent each transport belt on the outlet side of said inspection line and operated by said sort signals for physically redirecting pieces of fruit from each transport belt in accordance with the sort signal representative of each piece of fruit, each of said output lines having time delay means therein for delaying sort signals to the sorting means until the piece of fruit represented by the signals is adjacent the sorting means; and second digital computing means connected to said first digital computing means for receiving sort information from said first digital computing means, generating inventory records therefrom, and adjusting the sort points.

7. The system of claim 6 further defined by said first computing means operating upon the signals from each pair of sensors in accordance with a predetermined relation for producing a number representative of color therefrom in a predetermined scale of numbers as said processing of sensor signals.

8. A system for sorting produce on the basis of color, which comprises:

(a) transport means for the produce;

(b) means positioned along said transport means for directing a beam of light at said produce;

(c) means proximate to said light beam directing means for sensing light reflected by said produce in at least two separate wavelengths;

(d) first data processing means for determining a color level for a piece of the produce on the basis of the sensed light, determining a relationship between the color level and predetermined color sorting levels, producing output signals depending on the relationship, and resetting said sensing means;

(e) delay circuit means connected to said first data processing means to receive the output signals;

(f) sorting control circuitry connected to receive the output signals from said delay circuit means;

(g) sorting means for the produce positioned along said transport means and under control of said sorting control circuitry; and (h) a general purpose data processing system connected to said first data processing means for receiving sort information therefrom, generating produce inventory information therefrom and adjusting the predetermined color sorting levels.

9. The system of claim 8 in which the two wavelengths are respectively in the red and green portions of the visible spectrum and said first data processing means doubles a sensor signal obtained from the red light and divides same by the sum of the red sensor signal and a green sensor signal to produce a color level number for each item of produce, then compares the color level number for each piece of produce with predetermined sort point numbers to produce said output signals.

10. A system for sorting produce into categories on the basis of color, which comprises:

(a) transport means for the produce;

(b) means positioned along said transport means for directing a beam of light at said produce;

(c) means proximate to said light beam directing means for sensing light reflected by said produce in at least two separate wavelengths;

(d) a data processing means for determining a color level for a piece of the produce on the basis of the sensed light, determining a relationship between the color level and predetermined color sorting levels, producing output signals depending on the relationship, resetting said sensing means, and adjusting the predetermined color sorting levels to give a desired proportion of said produce in each sort category;

(e) delay circuit means connected to said first data processing means to receive the output signals;

(f) sorting control circuitry connected to receive the output signals from said delay circuit means; and (g) sorting means for the produce positioned along said transport means and under control of said sorting control circuitry.

11. The system of claim 10 in which the two wavelengths are respectively in the red and green portions of the visible spectrum and said first data processing means doubles a sensor signal obtained from the red light and divides same by the sum of the red sensor signal and a green sensor signal to produce a color level number for each item of produce, then compares the color level number for each piece of produce with predetermined sort point numbers to produce said output signals.

12. The system of claim 10 in which said data processing means additionally generates inventory information from the relationship between color level for the produce and the color sorting levels.

13. A method for sorting produce into categories on the basis of color, which comprises:

(a) directing a beam of light at each piece of said produce;

(b) sensing light reflected by said produce in at least two separate wavelengths;

(c) determining a color level for each piece of produce at each separate wavelength;

(d) determining a relationship between the color level and predetermined color sorting levels;

(e) sorting the produce on the basis of the determined relationship for each piece of produce, and (f) adjusting the predetermined color sorting levels on the basis of the proportion of said produce actually obtained in each category to give a desired proportion of said produce in each sort category.

14. The method of claim 13 in which two wavelengths are in the red and green portions of the visible spectrum and the relationship is determined by doubling the red color level and dividing same by the sum of the red color level and the green color level and comparing the level with a predetermined color sorting level.

15. The method of claim 14 additionally comprising the step of generating inventory information from the relationship between the color levels for each piece of produce and the color sorting levels.

* * * * *